US009169697B2

(12) United States Patent
Palmer

(10) Patent No.: US 9,169,697 B2
(45) Date of Patent: Oct. 27, 2015

(54) IDENTIFICATION EMITTERS FOR DETERMINING MILL LIFE OF A DOWNHOLE TOOL AND METHODS OF USING SAME

(71) Applicant: Larry T. Palmer, Spring, TX (US)

(72) Inventor: Larry T. Palmer, Spring, TX (US)

(73) Assignee: Baker Hughes Incorporated, Houston, TX (US)

( * ) Notice: Subject to any disclaimer, the term of this patent is extended or adjusted under 35 U.S.C. 154(b) by 360 days.

(21) Appl. No.: 13/775,897

(22) Filed: Feb. 25, 2013

(65) Prior Publication Data

US 2013/0256032 A1 Oct. 3, 2013

Related U.S. Application Data

(60) Provisional application No. 61/616,161, filed on Mar. 27, 2012.

(51) Int. Cl.
*E21B 12/02* (2006.01)
*E21B 29/00* (2006.01)

(52) U.S. Cl.
CPC ..... *E21B 12/02* (2013.01); *E21B 29/00* (2013.01)

(58) Field of Classification Search
CPC ..... E21B 12/02
See application file for complete search history.

(56) References Cited

U.S. PATENT DOCUMENTS 2,422,031 A 6/1947 Merten
2,457,960 A 1/1949 Walker
2,461,164 A 2/1949 Lewis
2,468,905 A 5/1949 Warren
2,560,328 A 7/1951 Bielstein
2,582,312 A 1/1952 Del Homme
2,657,909 A 11/1953 Bielsten
2,658,724 A 11/1953 Arps
3,011,566 A 12/1961 Graham
3,062,302 A 11/1962 Toth et al.

(Continued)

FOREIGN PATENT DOCUMENTS

GB 658323 A 10/1951
GB 1276311 A 6/1972

(Continued)

OTHER PUBLICATIONS

Leonid Tolotnyy, et al., Mutli-Tag RFID Systems, International Journal of Internet Protocol Technology (IJIPT), special issue on "RFID: Technologies, Applications, and Trends," pp. 1-13, 2007.

*Primary Examiner* — Brad Harcourt
(74) *Attorney, Agent, or Firm* — Parsons Behle & Latimer

(57) ABSTRACT

Downhole abrading tools have one or more identification tags disposed in or on the cutting end of the tools, and a housing having a detector and a relay module. The identification tags emit one or more signals that are detected by the detector which is disposed in close proximity to the cutting end. The relay module is operatively associated with the detector. During operation of the tool, the cutting end is worn causing release or destruction of one or more identification tags. The release or destruction of one or more identification tags causes a change in the signal or signals being detected by the detector. The signal change(s) is/are communicated through the relay module to the operator so that the operator can identify in real-time the amount of wear of the cutting end and, in some embodiments, the location of the wear of the cutting end.

13 Claims, 4 Drawing Sheets

(56) References Cited

U.S. PATENT DOCUMENTS

| | | | |
|---|---|---|---|
| 3,155,176 | A | 11/1964 | Bennett |
| 3,578,092 | A | 5/1971 | Tesch et al. |
| 3,678,883 | A | 7/1972 | Fischer |
| 3,714,822 | A | 2/1973 | Lutz |
| 3,853,184 | A | 12/1974 | McCullough |
| 3,865,736 | A | 2/1975 | Fries |
| 4,189,012 | A | 2/1980 | Garrett |
| 4,627,276 | A | 12/1986 | Burgess et al. |
| 4,655,300 | A | 4/1987 | Davis, Jr. et al. |
| 4,744,242 | A | 5/1988 | Anderson et al. |
| 4,785,894 | A | 11/1988 | Davis, Jr. et al. |
| 4,785,895 | A | 11/1988 | Davis, Jr. et al. |
| 4,818,153 | A | 4/1989 | Strandell et al. |
| 4,928,521 | A | 5/1990 | Jardine |
| 5,202,680 | A | 4/1993 | Savage |
| 5,305,836 | A | 4/1994 | Holbrook et al. |
| 5,415,030 | A | 5/1995 | Jogi et al. |
| 5,442,981 | A | 8/1995 | Vegh |
| 5,794,720 | A | 8/1998 | Smith et al. |
| 5,979,571 | A | 11/1999 | Scott et al. |
| 6,041,860 | A | 3/2000 | Nazzal et al. |
| 6,109,368 | A | 8/2000 | Goldman et al. |
| 6,131,675 | A | 10/2000 | Anderson |
| 6,233,524 | B1 | 5/2001 | Harrell et al. |
| 6,408,953 | B1 | 6/2002 | Goldman et al. |
| 6,414,905 | B1 | 7/2002 | Owens et al. |
| 6,443,228 | B1 | 9/2002 | Aronstam et al. |
| 6,484,824 | B2 | 11/2002 | Skyles |
| 6,543,312 | B2 | 4/2003 | Sullivan et al. |
| 6,631,772 | B2 | 10/2003 | Palaschenko |
| 6,648,082 | B2 | 11/2003 | Schultz et al. |
| 6,693,553 | B1 | 2/2004 | Ciglenec et al. |
| 6,725,947 | B2 | 4/2004 | Palaschenko et al. |
| 6,867,706 | B2 | 3/2005 | Collette |
| 6,915,848 | B2 | 7/2005 | Thomeer et al. |
| 6,923,273 | B2 | 8/2005 | Terry et al. |
| 6,943,697 | B2 | 9/2005 | Ciglenec et al. |
| 6,993,432 | B2 | 1/2006 | Jenkins et al. |
| 7,404,457 | B2 | 7/2008 | Xu et al. |
| 7,416,033 | B2 | 8/2008 | Hinshaw et al. |
| 7,424,910 | B2 | 9/2008 | Xu et al. |
| 7,464,771 | B2 | 12/2008 | Lynde |
| 7,487,571 | B2 | 2/2009 | Luk |
| 7,537,060 | B2 | 5/2009 | Fay et al. |
| 7,565,928 | B2 | 7/2009 | Lynde et al. |
| 7,575,070 | B2 | 8/2009 | Gaudette et al. |
| 7,581,595 | B2 | 9/2009 | Fay et al. |
| 7,591,314 | B2 | 9/2009 | Sonnier et al. |
| 7,600,581 | B2 | 10/2009 | Xu et al. |
| 7,604,061 | B2 | 10/2009 | Fay et al. |
| 7,635,033 | B2 | 12/2009 | Lynde |
| 7,708,086 | B2 | 5/2010 | Witte |
| 7,740,425 | B2 | 6/2010 | Zeiler et al. |
| 7,743,654 | B2 | 6/2010 | Spross et al. |
| 7,946,356 | B2 | 5/2011 | Koederitz et al. |
| 8,002,044 | B2 | 8/2011 | Fay et al. |
| 8,006,781 | B2 | 8/2011 | Teodorescu et al. |
| 2003/0156033 | A1 | 8/2003 | Savage et al. |
| 2004/0190374 | A1 | 9/2004 | Alft et al. |
| 2005/0267686 | A1 | 12/2005 | Ward |
| 2006/0000604 | A1 | 1/2006 | Jenkins et al. |
| 2006/0099885 | A1 | 5/2006 | Lynde et al. |
| 2007/0209802 | A1 | 9/2007 | Xu et al. |
| 2008/0000690 | A1* | 1/2008 | Lynde ..... 175/42 |
| 2009/0301778 | A1 | 12/2009 | Taylor |

FOREIGN PATENT DOCUMENTS

| | | | |
|---|---|---|---|
| JP | 2006-247814 | A | 9/2006 |
| WO | WO2005/113926 | A | 12/2005 |

* cited by examiner

IDENTIFICATION EMITTERS FOR DETERMINING MILL LIFE OF A DOWNHOLE TOOL AND METHODS OF USING SAME

RELATED APPLICATION

This application claims priority to, and the benefit of, U.S. Provisional Patent Application Ser. No. 61/616,161 filed Mar. 27, 2012.

BACKGROUND

1. Field of Invention

The invention is directed to downhole abrading tools utilized in oil and gas wells to abrade objects within the well and, in particular, to tools that are used to abrade, among other objects, stuck tools, bridge plugs, well tubing, and well casing disposed within the well in which wear of the working profile of the tool is monitored by the detection of signals being emitted from identification tags or emitters disposed on or within the working profile.

2. Description of Art

In the drilling, completion, and workover of oil and gas wells, it is common to perform work downhole in the well bore with a tool that has some sort of wearable working profile interfacing with a downhole structure. Examples include milling a downhole metal object with a milling tool, performing a washover operation with a rotary shoe, cutting through a tubular with a cutting or milling tool, or drilling through formation with a drill bit. During the performance of these operations, it is common for the working profile of the tool, such as cutting elements mounted on its lower or outer face, to wear away. As this wear progresses, the effectiveness of the tool decreases.

Generally, the tool is pulled from the well and replaced when the working profile has experienced a given amount of wear. The degree of wear at which it is desirable to replace the tool depends upon the type of tool and the operation being performed. Often, the decision as to when to pull the tool depends substantially on the experience of the operator. That is, the operator must estimate the amount of tool wear based on whatever is known about the time the operation has been underway, the weight on the tool, the type of downhole structure being worked, the cuttings found in the drilling fluid, or a gradual change in work string torque. None of these parameters, however, provides a definitive indication that the wear in the working profile has progressed to a specific degree at which the operator desires to pull the tool from the well. Pulling a tool prematurely adds unnecessary trips out of the well, adding to rig time and increased costs. Pulling the tool too late gradually decreases the effectiveness of the downhole operation, also adding to rig time and increasing the cost of the operation.

SUMMARY OF INVENTION

Broadly, the inventions are directed to downhole abrading tools utilized in cutting or abrading objects disposed within the well. The term "object" encompasses any physical structure that may be disposed within a well, for example, another tool that is stuck within the well, a bridge plug, the well tubing, the well casing, or the formation itself.

The downhole abrading tools disclosed herein comprise a working profile, a detector, and a relay module. The working profile includes one or more identification tags disposed within the working profile, e.g., the matrix disposed at the cutting end of the tool, or on the outer surface of the working profile. The detector senses or detects one or more signals being emitted by the identification tag(s) and informs the relay module of the condition of the one or more signals. The relay module, in turn, transmits the condition of the one or more signals to the operator of the tool located at the surface of the wellbore.

The detector is calibrated to receive the signal(s) being emitted by the identification tag(s) and to transmit this information to the relay module. The relay module, in turn, transmits the information to the operator. Depending on the condition of the signal(s), the operator is able to monitor the progression of wear on the working profile.

In one particular embodiment, a single signal is emitted by one or more identification tags such that a decrease in the strength or intensity of the single signal indicates to the operator that the working profile is being worn. In general, the decrease in the strength or intensity of the single signal occurs due to the identification tag(s) being destroyed during the cutting process, being removed from the working profile and carried away from the detector during the cutting process, or a combination of these two scenarios.

In other embodiments, one or more identification tags emit different signals that are detected by the detector. The absence of a first signal indicates a first condition of the working profile, and the absence of the a second signal indicates a second condition of the working profile. Thus, in these embodiments, specific areas of wear of the working profile can be monitored by the operator.

While the invention will be described in connection with the preferred embodiments, it will be understood that it is not intended to limit the invention to that embodiment. On the contrary, it is intended to cover all alternatives, modifications, and equivalents, as may be included within the spirit and scope of the invention as defined by the appended claims.

DETAILED DESCRIPTION OF INVENTION

Figure 1:
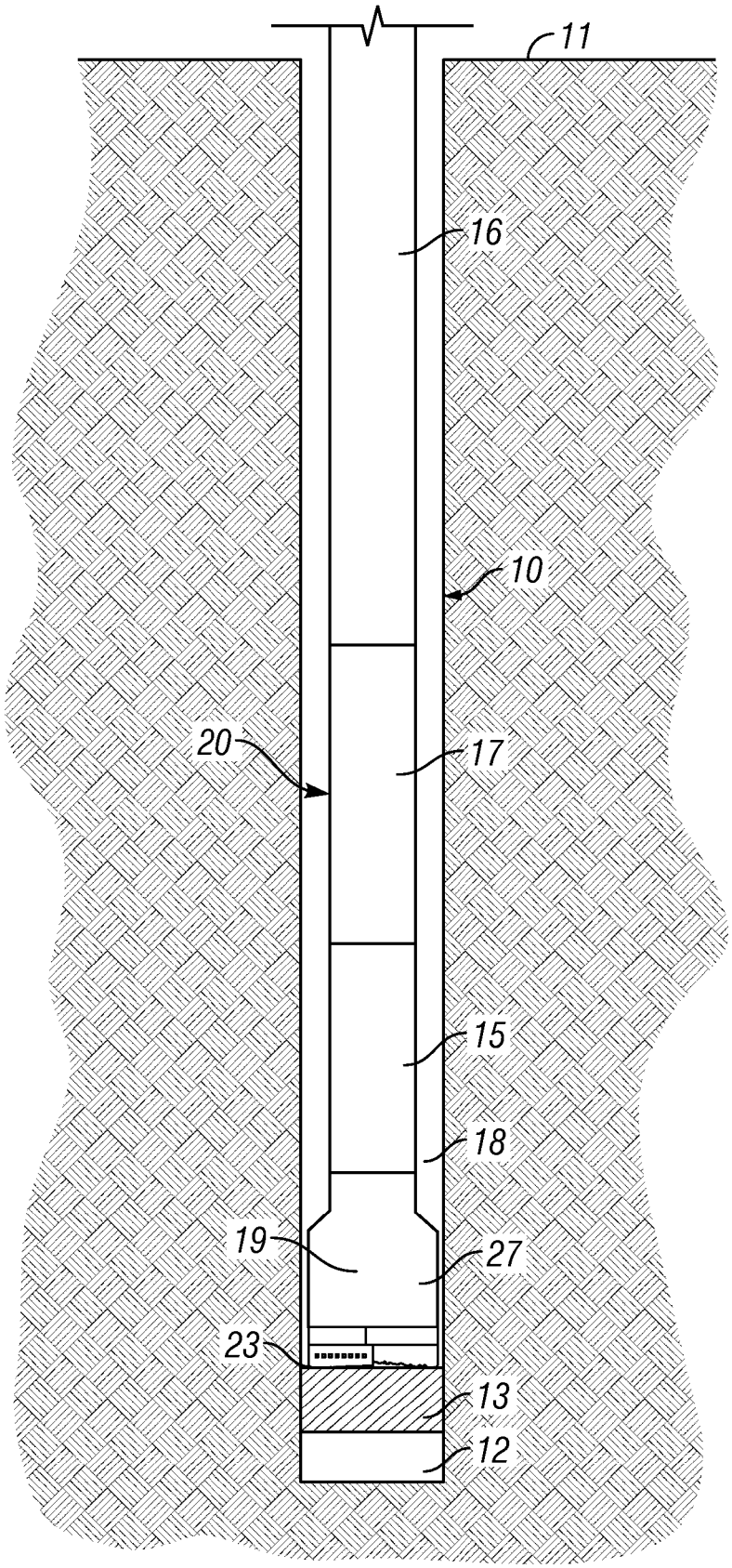
FIG. 1 is cross-sectional view of an oil or gas well showing a downhole abrading tool disclosed herein disposed within the well.

Referring to FIG. 1, oil and gas well 10 has a surface location 11 and a downhole location 12. Object 13 is disposed within well 10. Downhole abrading tool 20 is connected to rotating component (not shown) which, together with downhole abrading tool 20, is part of drill string 16. The rotating component can be a downhole drill motor or any other device known in the art. Alternatively, the entire drill string 16 can rotate. Downhole abrading tool 20 is placed in contact with object 13 and then rotated, using equipment known to persons skilled in the art, to abrade object 13.

Tool 20 includes mill 19, detector 15, and relay module 17. Identification emitter detector 15 is in close proximity to mill 19. As shown in FIG. 1, detector 15 is adjacent mill 19. Detector 15 senses or detects one or more signals being transmitted from one or more identification tags 30 (discussed in greater detail below) and relays the status of the signal(s) from identification tags 30 to the operator at surface location 11 through relay module 17. Relay module 17 can comprise a "measurement-while-drilling" or MWD module such as those disclosed in U.S. Pat. No. 7,591,314, which is incorporated herein in its entirety, with the modification that the MWD module includes a signal detector. As show in FIG. 1, relay module 17 is disposed just above detector 15. Detector 15 can be calibrated to receive any type of signal such as radio-frequency signals, radiation signals, and the like.

Relay module 17 can be any relay module known in the art. For example, relay module 17 can be one or more of the modules disclosed in U.S. Pat. No. 7,591,314 which, by reference herein, is incorporated herein in its entirety.

Detector 15 and relay module 17 can be powered by any power source known in the art, including, but not limited to, Bi-Directional Communication Power Modules available from Baker Hughes Incorporated located in Houston, Tex. such as those disclosed and described in U.S. Pat. No. 7,708,086 which, by reference herein, is incorporated herein in its entirety.

Figure 2:
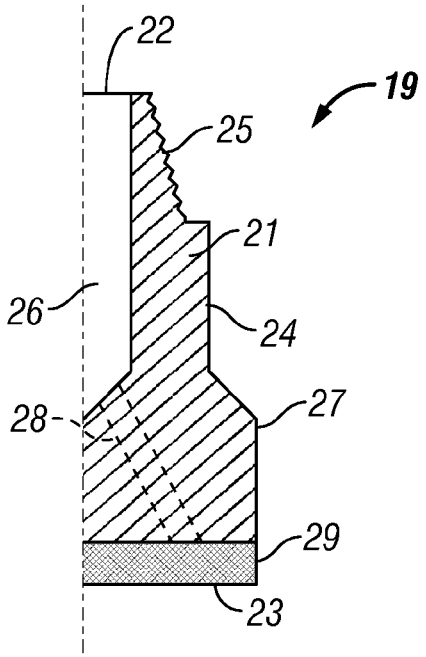
FIG. 2 is partial cross-sectional view of the mill of the downhole abrading tool shown in FIG. 1.
Figure 3:
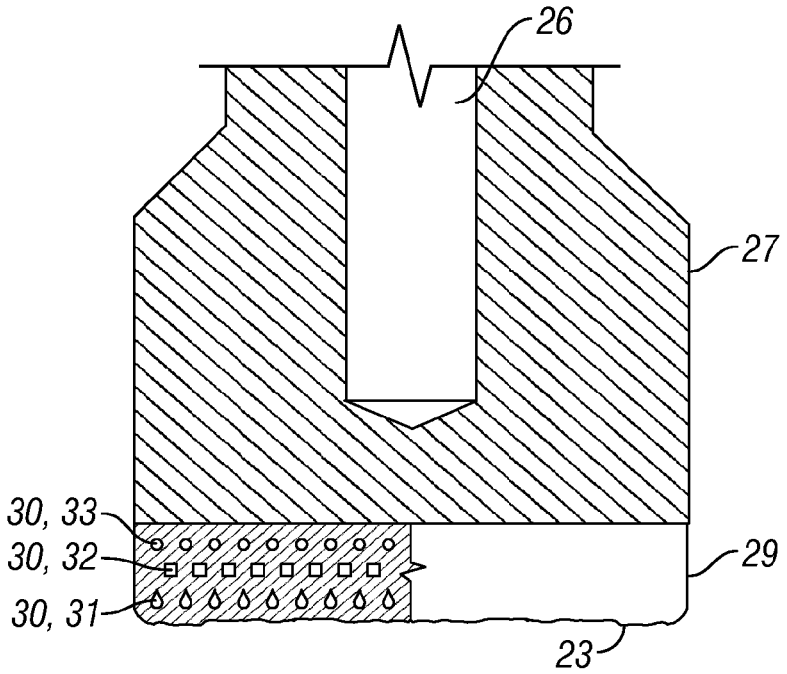
FIG. 3 is partial cross-sectional view of a specific embodiment of a mill of the downhole abrading tool shown in FIG. 1.

As illustrated in FIGS. 2-3, in one particular embodiment, mill 19 includes body 21, having first end 22, working profile or cutting end 23, exterior surface 24, passage 26, and head 27. First end 22 is adapted to be connected to detector 15 or other drill string component to facilitate rotation of downhole abrading tool 20. First end 22 preferably includes threads 25 to facilitate attachment to detector 15 or other drill string component.

Passage 26 is disposed longitudinally within body 20 to permit drilling fluid to flow through downhole abrading tool 20. Accordingly, drilling fluid (not shown) flows from equipment (not shown) located at surface 11, through drill string 16, through passage 26, and through drilling fluid nozzles 28 (shown in dashed lines) into well environment 18 (FIG. 1) and back up to the surface location 11. The drilling fluid facilitates cutting by downhole abrading tool 20.

Cutting end 23 includes abrading matrix 29 formed of an abrading material, such as hardfacing or other cutting material known in the art, having one or more identification tags 30 disposed or embedded therein. Alternatively, or in addition, one or more identification tags 30 can be disposed on an outer surface of cutting end 23 such as being placed directly on the outer surface of cutting end 23 or by including identification tag(s) 30 on or as part of a cutting element affixed to the cutting end. Each identification tag 30 may be, for example, a radio-frequency tag, a radioactive material, or other device or material that emits a signal that can be detected by detector 15. Thus, examples of such signals include, but are not limited to radio frequency or radioactivity. As abrading matrix 29 is worn away due to excessive wear on cutting end 23 of downhole abrading tool 20, one or more identification tags 30 is released from abrading matrix 29 into well environment 18 and, thus, into the drilling fluid where it is carried away from detector 15. Alternatively, or in addition, one or more identification tags 30 is destroyed such that the signal(s) previously being emitted by identification tags 30 is/are no longer being emitted and, thus, detected by detector 15.

Removal and/or destruction of identification tag(s) 30 causes a change in the signal(s) being emitted by identification tag(s) 30 and, thus, being detected by detector 15. The removal and/or destruction of identification tag(s) 30 can alter the signal(s) due to a lessening of the intensity of a combined identical signal being emitted by each of identification tags 30, or by no longer detecting a specific signal being emitted by a specific identification tag 30, or a combination of both, or through any other method in which removal or destruction of a previously emitting identification tag 30 causes a change in a signal condition such as from a baseline signal or signals being sensed by detector 15.

Upon detector 15 sensing the change in the signal or signals being emitted by one or more identification tags 30, detector 15 transmits or relays the change of the signal(s) to relay module 17 which, through methods known in the art, transmits or communicates the change in signal condition to the operator at surface location 11. Thus, detector 15 is operatively associated with relay module 17 which, in turn, is operatively associated with equipment located at surface location 11. As a result, detection of the removal and/or destruction of one or more identification tags 30, which indicate to the operator certain characteristics of the wear of cutting end 23, can be relayed to the operator in "real-time," i.e., within a few minutes of the removal or destruction of the one or more identification tags 30, and well before a released identification tag 30 could flow to surface location 11. Thus, detection of a change in one or more signals being emitted by one or more identification tags 30 provides an indication that downhole abrading tool 20 has experienced wear. Therefore, the operator can decide whether to remove downhole abrading tool 20 from well 10 to replace it with a new downhole abrading tool 20, or replace mill 19 with a new mill, or whether milling operations can proceed.

In one specific embodiment, identification tags 30 may be formed integral with the abrading material that forms abrading matrix 29. In other words, in this embodiment, identification tags 30 are embedded or disposed within abrading matrix 29 during the formation of abrading matrix 29.

As shown in FIG. 3, different identification tags 30 are disposed at different locations within abrading matrix 29, thereby providing different indications as to the extent of wear on cutting end 23. For example, generally, identification tags 31 are released or destroyed prior to identification tags 32, and identification tags 32 are released or destroyed prior to identification tags 33, as cutting end 23 is worn away in the upward direction shown in FIG. 3. Accordingly, an operator is provided with incremental indication as to the wear on cutting end 23. Alternatively, identification tags 31, 32, and 33 can be disposed in specific areas of abrading matrix 29, e.g., identification tags 31 on the sides, identification tags 32 on the bottom, and identification tags 33 in the middle so that an indication can be made as to the specific area or region of cutting end 23 undergoing wear.

Various combinations of the different types of identification tags 30 can be used to better educate the operator as to the location of the wear on cutting end 23 as well as the degree of wear occurring at various locations of cutting end 23. For example, identification tags 30 comprising RFID tags emitting a first signal can be released if wear occurs on the outer portions of abrading matrix 29 and identification tags 30 comprising having RFID tags emitting a second signal may be released if wear occurs on the center portion of abrading matrix 29. Similarly, every RFID tag may emit a different signal that corresponds to a specific location within abrading matrix 29 or on cutting end 23. In this specific embodiment, the absence of the specific signal being emitted by the specific RFID tag due to its removal or destruction would indicate to the operator the exact location in abrading matrix 29 or on cutting end 23 that has been worn.

In alternative embodiments, identification tags 30 may comprise one or more radioactive material that emits one or more radioactive signals that are sensed by detector 15. In one particular embodiment, all of the radioactive signals are identical such that removal or destruction of one or more identification tags 30 causes the combined radioactive signal to lessen. As will be recognized by persons skilled in the art, in this particular embodiment, the operator is not informed as to which portion of cutting end 23 is worn away. Therefore, in other embodiments, numerous radioactive materials, each emitting different radioactive signals, can be disposed within abrading matrix 29 or on cutting end 23 such that the absence of the particular radioactive signal due to the identification tag 30 being removed or destroyed would identify to the operator the portion or portions of cutting 23 that has been worn away.

In embodiments in which identification tag(s) 30 comprise radioactive materials, detector 15 senses or detects radioactivity levels and transmits the levels to the relay module which, in turn, transmits the levels to an operator located at surface location 11. Suitable detectors 15 for radioactive materials in downhole environments are known in the art.

In still other embodiments, to better monitor wear at specific location along or within cutting end 23, identification tags 30 can comprise a combination of RFID tags and radioactive tags and, thus, detector 15 is capable of detecting both radio frequency signals and radioactive signals.

Figure 4:
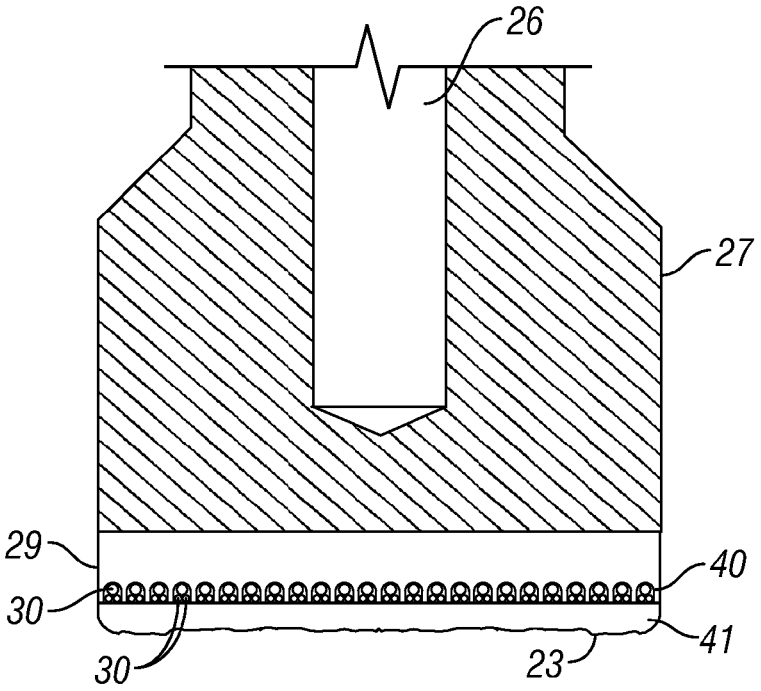
FIG. 4 is cross-sectional view of another specific embodiment of a mill of the downhole abrading tool shown in FIG. 1.

Referring now to FIG. 4, in another specific embodiment, abrading matrix 29 includes holes 40 having one or more identification tags 30 disposed therein. Each hole 40 is formed by drilling into abrading matrix 29. One or more identification tags 30 is then disposed within each hole 40 and overlaid with an abrasive material that forms abrading matrix 29. When excessive wear of abrading matrix 29 occurs, holes 40 are exposed to well environment 18 and identification tags 30 are released from abrading matrix 29 and into well environment 18 and carried with the drilling fluid away from detector 15. Alternatively, or in addition, identification tags 30 are destroyed by cutting end 23 being ground against object 13.

Figure 5:
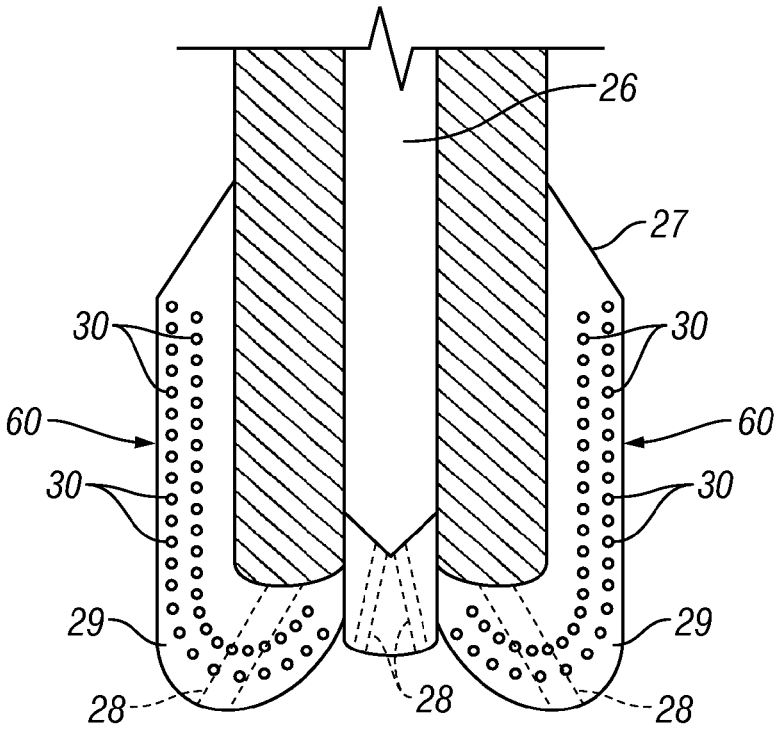
FIG. 5 is a partial cross-sectional view of an additional specific embodiment of a mill of the downhole abrading tool shown in FIG. 1.
Figure 6:
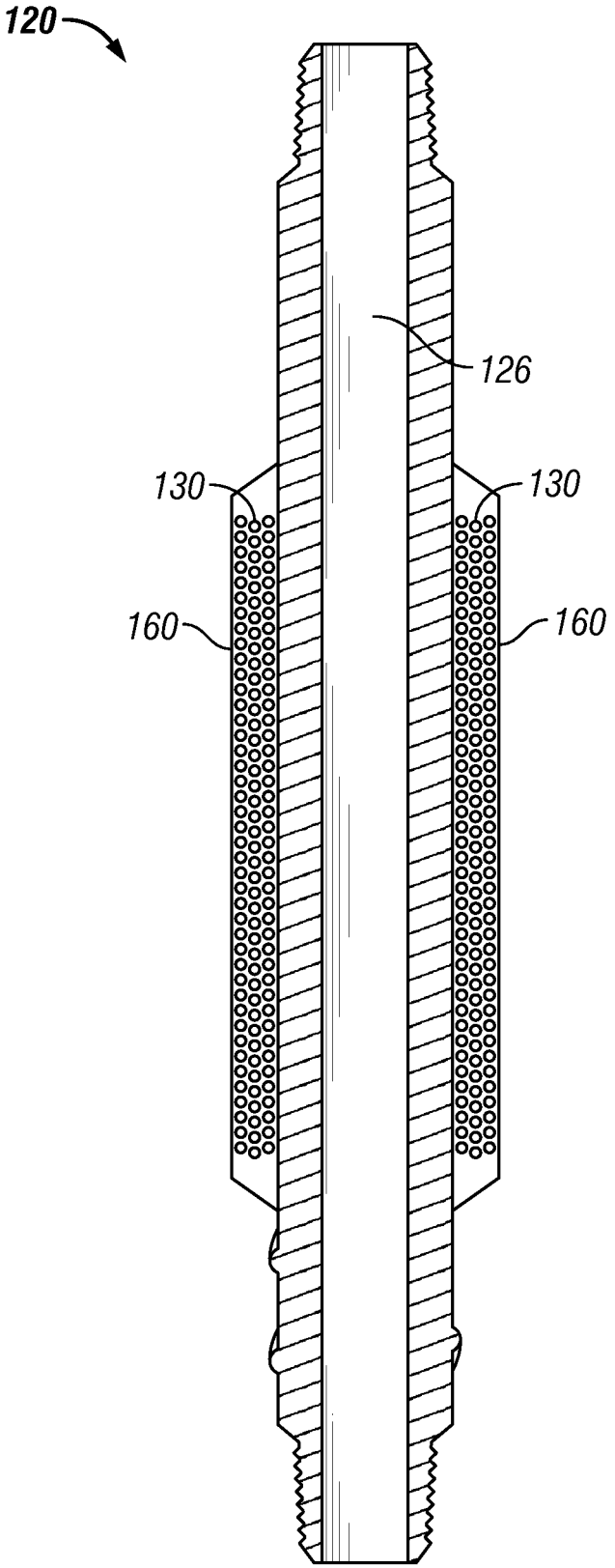
FIG. 6 is a partial cross-sectional view of another specific embodiment of a downhole abrading tool disclosed herein.

As will be understood by persons skilled in the art, downhole abrading tool 20 may abrade objects in numerous different ways utilizing numerous different structurally designed heads 27 and abrading matrixes 29. For example, as shown in FIG. 5, downhole abrading tool 20 includes blades 60 having identification tags 30 disposed therein. As with identification tags 30 discussed above with respect to FIG. 3, identification tags 30 may be arranged along blades 60 to allow identification of which blade 60 and/or, which portion of blade 60, is being worn. In an alternative embodiment, as shown in FIG. 6, downhole abrading tool 120 includes a tubular member having passage 126 with blades 160 disposed on the outer wall surface of the tubular member. Blades 160 comprise identification tags 130 disposed on or within an abrading matrix forming blades 160. As with identification tags 130 discussed above with respect to FIGS. 3 and 5, identification tags 130 may be arranged along blades 160 to allow identification of which blade 160 and/or, which portion of blade 160, is being worn. Therefore, it is to be understood that the invention is not limited to the exact details of construction, operation, exact materials, or embodiments shown and described, as modifications and equivalents will be apparent to one skilled in the art. Accordingly, the invention is therefore to be limited only by the scope of the appended claims.

What is claimed is:

1. A downhole abrading tool for use in a well, the downhole abrading tool comprising:

a housing;

a cutting end disposed on a lower end of the housing, the cutting end having an identification tag that emits a signal;

a detector for receiving the signal being emitted by the identification tag, the detector disposed in the housing at a location relative to the cutting end to enable the detector to receive the signal being emitted by the identification tag; and a relay module disposed in the housing and operatively associated with the detector for receiving a first communication from the detector regarding a first condition of the signal and transmitting the first communication to an operator located at the surface location, wherein a change in the first condition of the signal indicates wear on the cutting end; and wherein the change in the first condition of the signal comprises a lessening of strength of the signal.

2. The downhole tool of claim 1, wherein the detector is disposed adjacent the cutting end.

3. The downhole tool of claim 1, wherein the relay module is disposed adjacent the cutting end.

4. The downhole tool of claim 1, wherein the identification tag is embedded in a cutting matrix of the cutting end.

5. The downhole tool of claim 1, wherein the identification tag is disposed on a surface of the cutting end.

6. The downhole tool of claim 1, wherein the identification tag is disposed on a blade of the cutting end.

7. The downhole tool of claim 6, further comprising a cutting element disposed on the blade, the identification tag being operatively associated with the cutting element.

8. The downhole tool of claim 7, wherein the identification tag is disposed at least partially in the cutting element.

9. A method of determining wear of a downhole abrading tool, the method comprising the steps of:

(a) abrading an object disposed in a wellbore with a downhole tool having a working profile, the working profile including an identification tag, the identification tag emitting a signal;

(b) detecting at a location in close proximity to the working profile a first strength of the signal; and (c) detecting at the location in close proximity to the working profile a second strength of the signal, the difference between the first strength and the second strength indicating wear of the working profile, wherein the second strength of the signal comprises an absence of the first strength of the signal.

10. The method of claim 9, wherein steps (b) and (c) are performed by a detector disposed adjacent the working profile.

11. The method of claim 9, wherein the signal comprises an accumulation of individual signals being emitted by a plurality of identification tags.

12. The method of claim 9, wherein after steps (b) and (c), the first strength of the signal and second strength of the signal, respectively, are communicated to a surface location.

13. The method of claim 9, wherein the first strength of the signal is emitted by a first identification tag and the second strength of the signal is emitted by a second identification tag.

* * * * *